US008806841B2

(12) United States Patent
Cerf

(10) Patent No.: US 8,806,841 B2
(45) Date of Patent: Aug. 19, 2014

(54) APPARATUS FOR NESTING CONTAINERS

(76) Inventor: Alain Cerf, Reading Beach, FL (US)

( * ) Notice: Subject to any disclaimer, the term of this patent is extended or adjusted under 35 U.S.C. 154(b) by 529 days.

(21) Appl. No.: 13/067,625

(22) Filed: Jun. 15, 2011

(65) Prior Publication Data

US 2012/0317925 A1 Dec. 20, 2012

(51) Int. Cl.
*B65B 11/00* (2006.01)

(52) U.S. Cl.
USPC ..... 53/443; 53/534; 53/542

(58) Field of Classification Search
USPC ..... 53/443, 446, 448, 534, 537, 542, 543; 198/418, 418.7, 418.8, 419.3, 429, 198/430; 414/791.7, 791.6, 794.7
See application file for complete search history.

(56) References Cited

U.S. PATENT DOCUMENTS

| | | | | | |
|---|---|---|---|---|---|
| 3,528,541 | A * | 9/1970 | Prowant et al. | ..... | 198/760 |
| 3,619,967 | A * | 11/1971 | Alduk | ..... | 53/448 |
| 4,041,674 | A * | 8/1977 | Reid | ..... | 53/496 |
| 4,756,139 | A * | 7/1988 | Le Bras | ..... | 53/398 |
| 4,878,337 | A * | 11/1989 | Raudat et al. | ..... | 53/534 |
| 5,123,231 | A * | 6/1992 | Fallas et al. | ..... | 53/493 |
| 5,522,692 | A * | 6/1996 | Simkowski | ..... | 414/789.5 |
| 7,073,656 | B2 * | 7/2006 | Gust et al. | ..... | 198/453 |
| 7,128,217 | B2 * | 10/2006 | Henry | ..... | 209/643 |
| 7,726,464 | B2 * | 6/2010 | Cerf | ..... | 198/419.3 |
| 7,815,034 | B2 * | 10/2010 | Fleck et al. | ..... | 198/437 |
| 8,235,201 | B2 * | 8/2012 | Miller et al. | ..... | 198/419.3 |
| 8,256,192 | B2 * | 9/2012 | Cerf | ..... | 53/442 |
| 8,534,450 | B2 * | 9/2013 | Werner et al. | ..... | 198/429 |
| 2002/0059785 | A1 * | 5/2002 | Gamberini | ..... | 53/543 |
| 2006/0042188 | A1 * | 3/2006 | Ford | ..... | 53/398 |
| 2007/0068121 | A1 * | 3/2007 | Mate et al. | ..... | 53/543 |
| 2008/0283360 | A1 * | 11/2008 | Aronsson | ..... | 198/419.3 |
| 2010/0326015 | A1 * | 12/2010 | Miller et al. | ..... | 53/443 |
| 2011/0132800 | A1 * | 6/2011 | Cerf | ..... | 206/597 |
| 2012/0031050 | A1 * | 2/2012 | Werner et al. | ..... | 53/448 |

* cited by examiner

*Primary Examiner* — Hemant M Desai
(74) *Attorney, Agent, or Firm* — Sam Silverberg

(57) ABSTRACT

The invention is to accumulate the bottles in a nested formation at a high speed on a moving conveyor and the reduction or elimination of gaps between the nested bottles that are caused by missing bottles. The is done by oscillating the conveyor belt Another objective of the invention is to accumulate a predetermined number of bottles in rows to be bundled by establishing a first barrier to retain the bottles on the conveyor and using second barrier to control the number of rows to be included in the bundle.

20 Claims, 3 Drawing Sheets

APPARATUS FOR NESTING CONTAINERS

FIELD OF THE INVENTION

This invention is directed to nesting containers such as bottles on a moving conveyor and reducing the number of gaps between bottles that tend to form when the bottles are nested on the conveyor. After nesting the containers, the nested containers are moved on a conveyor to a film wrapping station and then to through a heat shrink tunnel to shrink the film to form a bundle of containers.

SUMMARY OF THE INVENTION

The objective of the invention is to accumulate the bottles in a nested formation at a high speed on a moving conveyor and the reduction or elimination of gaps between the bottles that are caused by missing bottles. The is done by oscillating the conveyor belt Another objective of the invention is to accumulate a predetermined number of bottles in rows to be bundled by establishing a first barrier to retain the bottles on the conveyor and using second barrier to control the number of rows to be included in the bundle.

DETAILED DESCRIPTION OF THE INVENTION

Figure 1:
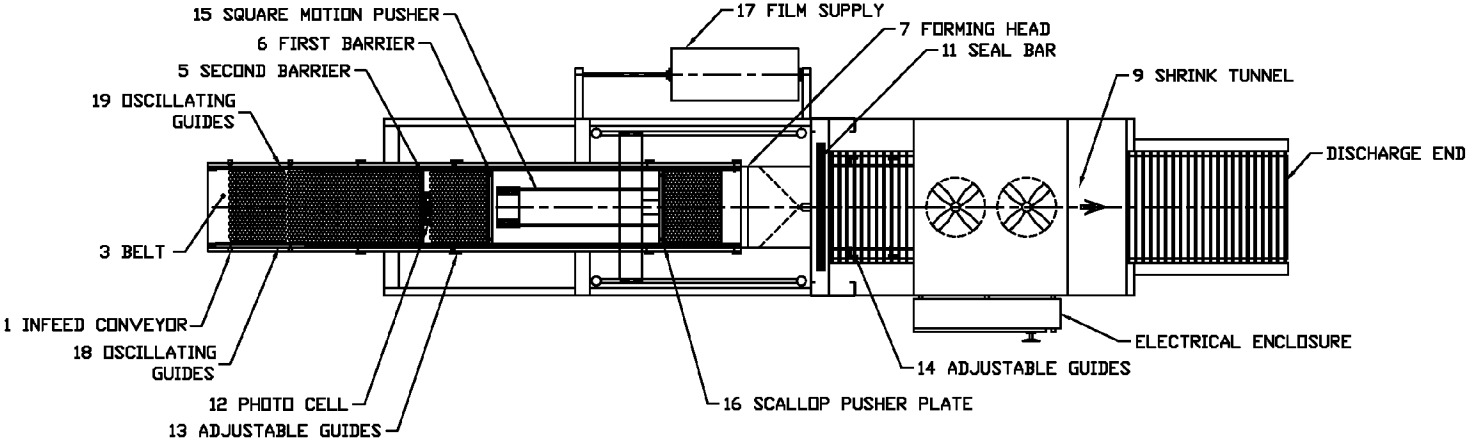
FIGS. 1 and 2 show containers on a moving oscillating conveyor pressing against a first barrier causing the containers to form a nested arrangement.
Figure 2:
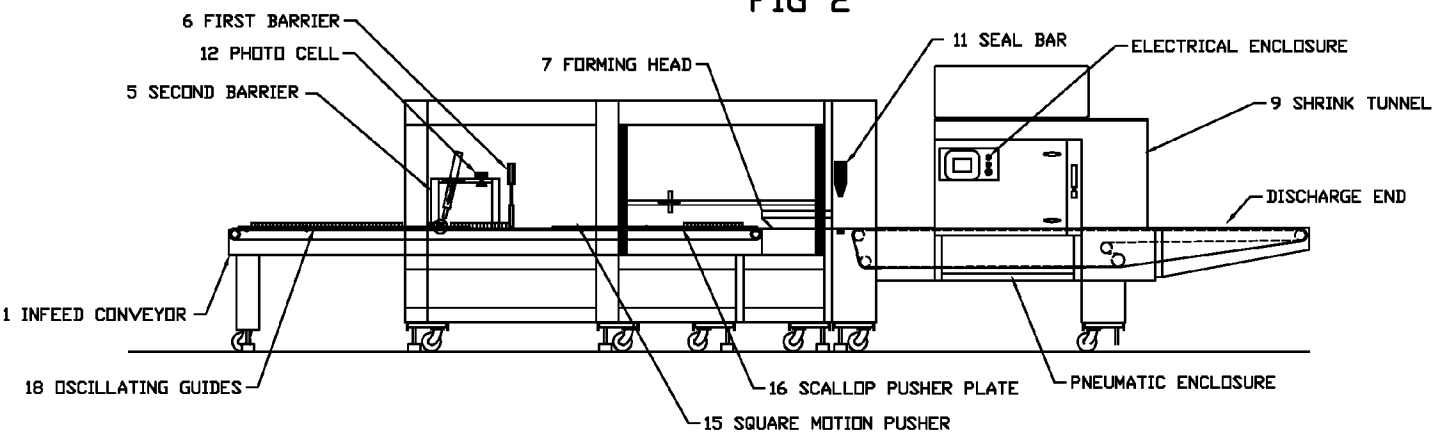

This invention is directed to making bundles of containers that can be placed on pallets. Depending on the size of the containers the dimension of the bundle can be approximately 1/16 to 1/2 of pallet. FIGS. 1 and 2 show transporting containers 2 resting on a moving oscillating conveyor belt 3 of an in feed conveyor 1. The containers are moved against a first barrier causing the containers to form a nested arrangement. The nested containers 2 form gaps where containers can be missing. To reduce or eliminate the gaps the containers can be shaken by oscillating side guides or by oscillating the conveyor belt 3. An oscillation of about 0.5 inch is usually sufficient to reduce or eliminate the gaps. The preferred embodiment is to oscillate the moving conveyor belt 3. This can be accomplished by using two oscillating side guides 18 and 19 located on each side of the belt to move the conveyor belt sideways by pushing the conveyor belt back and forth while the adjustable guides keep the containers on the conveyor belt in a stable condition. The adjustable side guides have enough play to accommodate the movement of the belt and still maintain stability of the containers. The conveyor belt can be rigid or flexible. If a rigid belt is used the belt and the belt pulleys at each end of the conveyor will have to move sideways as a unit. The preferred embodiment is to use a flexible belt such as made by Regina under the name Matveyar to avoid having to move the pulleys. This belt is made of small plastic elements that allow the oscillating side guides 18, 19 to move the belt sideways under the containers without moving the pulleys.

Figure 3:
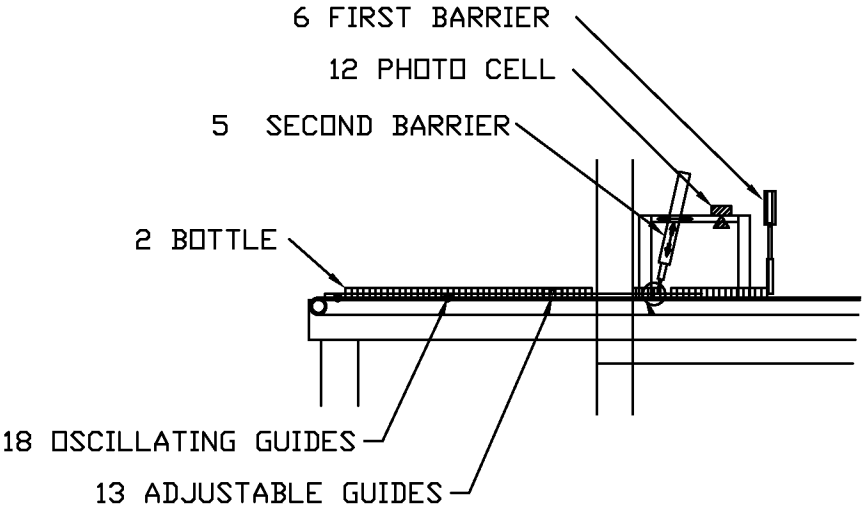
FIG. 3 shows a blown of view of the first and second barriers with the oscillating guides.

FIG. 3 shows the oscillating guides 18, 19 almost parallel to the plane of the conveyor belt. The adjustable guides 13 are above the oscillating guides 5

Figure 5:
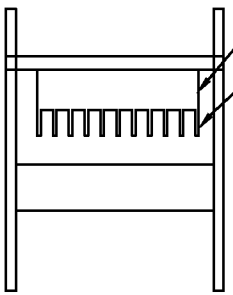
FIG. 5 shows a second barrier.
Figure 6:
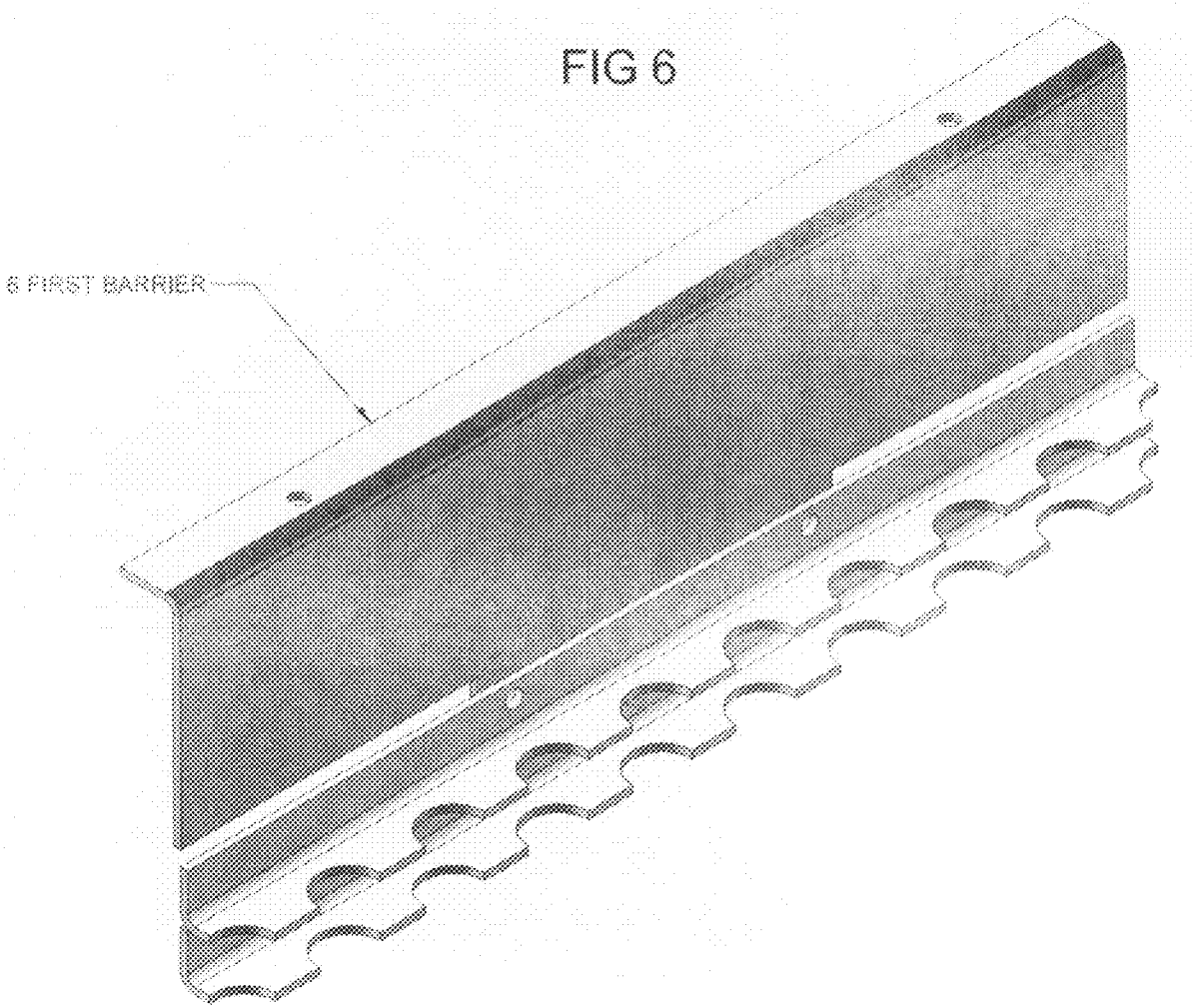
FIG. 6 shows a scalloped first barrier.

Figure one and two show a oscillating conveyor belt 4 moving the containers 2 on an in feed conveyor toward a first barrier 6. First barrier 6 stops the containers from moving on the conveyor and allows the containers to nest and form rows as they accumulate against the first barrier 6. To form the nesting, the first barrier 6, as shown in FIG. 6, can be a flat plate having scallops to accommodate the diameter of the containers. The moving conveyor forces the containers into the scalloped plate causing a nested arrangement. The preferred embodiment is to manually place a number of rows of containers in a nested arrangement against a flat first barrier before the conveyor begins to run. Three nested rows of manually placed is sufficient to initiate the nesting of the moving containers. This alleviates the need to replace the first barrier with scallops to accommodate containers having a different diameter. After a predetermined number of rows of the containers have accumulated against the manually placed rows pressing against the first barrier 6, a second barrier 5 having fingers 10, shown in FIG. 5, is inserted between the last row of the predetermined number of containers and the first row of the next predetermined number of containers to stop the movement of the containers. When the containers are of sufficient diameter the fingers are inserted in a vertical position between the rows of containers into the diamonds formed by the nested containers. Usually there will be one finger for every other container in the row. After the second barrier is inserted, the first barrier is moved to release the predetermined number of rows of nested containers trapped between the barriers. Usually the movement of the first barrier 6 is delayed until at least a sufficient number of rows to make about two bundles of containers behind the second barrier. The released rows of containers are conveyed to the forming head 7. A square motion pusher having a scallop pusher plate to accommodate the structure of the nested bottles sits above the height of the bottles. After the bundle has gone passed the pusher to the forming head, the pusher will lower and push the bottles through the forming head 7 and over the seal bar 1. Then the square motion pusher retracts to its previous position by rising back up so the next bundle can pass underneath. At the forming head 7, the predetermined number of rows of containers is film wrapped with film 17 into a bundle. Sealing bar 11 seals the rear of the bundle. Then the bundle is transported to a heat shrink tunnel 9 to shrink the film.

The position of the second barrier with respect to the first barrier needs to be adjusted to accommodate containers having various diameters. This achieved by adjusting the distance between the first and second barrier. To achieve this adjustment the second barrier is mounted as shown in FIG. 3 that allows the second barrier to be moved horizontally. Using a screw with a stepper motor or a servomotor, the second barrier can be horizontally positioned to the desired distance from the first barrier.

The desired distance between the barriers can be calculated by using the diameter of the containers and the desired number of rows of containers. This can be done manually or by a conventional sensor such as optical sensor or a capacitance sensor or a clamp potentiometer that can provide the diameter of a sample bottle and sends the data to a computer that calculates where the second barrier has to be positioned in relation to the number of rows to achieve the desired number of rows to be bundled. The computer can send a signal to the servo motor or stepper motor to move the barrier to the correct position. A photo cell 12 or a vision system can be used to check the exact position of the last bottle in the row and if needed to provide data to a computer that will provide a signal to move the second barrier to the correct position.

Figure 4:
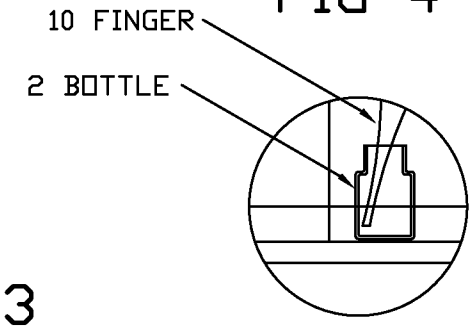
FIG. 4 shows a finger of the second barrier in a bottle.

When the containers are empty bottles and the diameters of the bottles are small such as 19 to 25 mm there is almost no room to insert the fingers of the second barrier. In this situation the barrier 5 has fingers 10 to accommodate every other bottle. FIG. 4 shows the finger 10 inserted inside the upper opening of the bottle 2. The fingers are inserted at an angle and will stop against the inside body of the bottle. The insertion of the finger 10 into a bottle needs be controlled to accommodate the shape of the bottle. If the bottle is high and the fingers rest on the inside the neck of the bottle, the bottle can become unstable and tip. To adjust for different types of bottles, a sensor such as potentiometer sensor, having a moving vertical plate, can be used determine the height of a sample bottle and send a data to a computer that can create a signal to adjust the stroke length of the second barrier. A servomotor or a stepper motor can be used to change the stroke length of the finger. The first or second barrier is generally coated with a Teflon or a ceramic coating.

By sensing the diameter of the containers the computer can automatically calculate the distance between the barriers and automatically adjust to accommodate the number of rows between the barriers.

The invention claimed is:

1. An apparatus for nesting containers resting on a moving conveyor belt comprising means for reducing the number of gaps or eliminating the gaps from the moving nested containers when a container is missing while the conveyor is moving, means for restraining the movement of the containers by a first barrier thereby allowing rows of containers to accumulate in a nested arrangement, means for separating a predetermined number of containers arranged in rows while the conveyor is moving, means for film wrapping the predetermined number of containers arranged in rows.

2. An apparatus according to claim 1 wherein the means for reducing the number of gaps or for eliminating the gaps between the nested containers includes means for oscillating the conveyor belt underneath the rows of container.

3. An apparatus according to claim 2 wherein guides are used to keep the containers on the conveyor belt stable while the belt is oscillating.

4. An apparatus according to claim 2 wherein means for oscillating include oscillating guides located on each side of the conveyor belt to push the belt back and forth to create the oscillation.

5. An apparatus according to claim 2 including means for placing rows of nested bottles against the first barrier to initiate the nesting of the containers on the moving conveyor.

6. An apparatus according to claim 1 including a second barrier having fingers is located a distance from the first barrier that can be inserted between the accumulated rows of containers to separate a predetermined number of rows.

7. An apparatus according to claim 6 including means for moving the second barrier horizontally to a position that allows a predetermined number of rows to be separated.

8. An apparatus according to claim 6 wherein the container is a bottle and including means for inserting a second barrier having fingers set at an angle into the upper opening of the bottle so that the fingers will stop against the body of the bottle.

9. An apparatus according to claim 6 including means for calculating the desired distance between the first and second barrier.

10. An apparatus according to claim 9 including a sensor for determining the diameter of a container and sending the data from the sensor to a means for calculating the distance between the first and second barriers to establish the predetermined number of rows to be separated.

11. An apparatus according to claim 10 including a sensor to measure the height of the container and send the information to a computer to calculate the stroke length of the barrier fingers inserted inside the bottle.

12. A process for nesting containers resting on a moving conveyor belt comprising, reducing or eliminating the number of gaps between the nested containers when a container is missing while the conveyor is moving, restraining the movement of the containers by a first barrier thereby allowing nested rows of containers to accumulate, separating a predetermined number of containers arranged in rows while the conveyor is moving, and film wrapping the predetermined number of containers arranged in rows.

13. A process according to claim 12 including oscillating the conveyor belt underneath the rows of container to reduce or eliminate the number of gaps between the containers.

14. A process according to claim 13 wherein the oscillating guides located on each side of the conveyor belt the conveyor push the belt back and forth belt to create the oscillation.

15. A process according to claim 12 including inserting second barrier having fingers located a distance from the first barrier between the accumulated rows of containers to separate a predetermined number of rows.

16. A process according to claim 15 including moving the second barrier horizontally to change the distance between the first barrier and the second barrier so that a predetermined number of rows can be separated.

17. A process according to claim 15 wherein the container is a bottle and including the step of inserting a second barrier having fingers set at an angle into the upper opening of the bottle so that the fingers will stop against the body of the bottle.

18. A process according to claim 15 where in rows of nested containers are placed against the second barrier to initiate the nesting of the containers moving on an oscillating conveyor belt.

19. An apparatus for nesting containers resting on a moving conveyor belt comprising means for oscillating the conveyor belt while the conveyor is moving to reduce the number of gaps or eliminating the gaps from the moving nested containers when a container is missing, means for separating a predetermined number of containers, means for restraining the movement of the containers by a barrier thereby allowing rows of containers to accumulate against the barrier.

20. A process for nesting containers resting on a moving conveyor belt comprising, oscillating the moving conveyor belt to reduce or eliminate the number of gaps between the nested containers when a container is missing, separating a predetermined number of containers arranged in rows while the conveyor is moving, and restraining the movement of the containers by a barrier thereby allowing rows of nested containers to accumulate against the barrier.

* * * * *